US005121165A

United States Patent [19]

Yoshida et al.

[11] Patent Number: 5,121,165

[45] Date of Patent: Jun. 9, 1992

[54] DEVELOPER UNIT AND A TONER HOPPER FOR AN IMAGE FORMING DEVICE

[75] Inventors: Seitaro Yoshida; Kunio Nakai; Shinji Ogaki; Hiroshi Kageyama, all of Osaka; Sueaki Okamoto, Kyoto; Hiroyuki Hamakawa, Nara; Yoshiaki Tabata, Osaka; Kenichi Ashida, Hyogo, all of Japan

[73] Assignee: Mita Industrial Co., Ltd., Osaka, Japan

[21] Appl. No.: 426,748

[22] Filed: Oct. 24, 1989

[30] Foreign Application Priority Data

| | | | |
|---|---|---|---|
| Oct. 28, 1988 | [JP] | Japan | 63-141421[U] |
| Oct. 28, 1988 | [JP] | Japan | 63-141430[U] |
| Oct. 28, 1988 | [JP] | Japan | 63-141431[U] |
| Jul. 31, 1989 | [JP] | Japan | 1-198527 |
| Jul. 31, 1989 | [JP] | Japan | 1-198528 |
| Jul. 31, 1989 | [JP] | Japan | 1-198529 |
| Jul. 31, 1989 | [JP] | Japan | 1-198532 |

[51] Int. Cl.[5] ..... G03G 15/06; G03G 21/00

[52] U.S. Cl. ..... 355/260

[58] Field of Search ..... 355/245, 260, 210, 251

[56] References Cited

U.S. PATENT DOCUMENTS

| | | | |
|---|---|---|---|
| 4,089,601 | 5/1978 | Navone | 355/245 |
| 4,460,267 | 7/1984 | Ogawa | 355/251 |
| 4,583,832 | 4/1986 | Kasamura et al. | 355/260 |
| 4,607,939 | 8/1986 | Saito | 355/245 X |
| 4,650,097 | 3/1987 | Hagihara et al. | 355/260 X |
| 4,891,674 | 1/1990 | Seyfried | 355/245 |

FOREIGN PATENT DOCUMENTS

| | | | |
|---|---|---|---|
| 57-26881 | 2/1982 | Japan | 355/260 |
| 61-137172 | 6/1986 | Japan | 355/260 |
| 61-295582 | 12/1986 | Japan | 355/260 |
| 63-221370 | 9/1988 | Japan | 355/260 |

*Primary Examiner*—Fred L. Braun

*Attorney, Agent, or Firm*—Koda and Androlia

[57] ABSTRACT

A toner hopper which is arranged upwards of the developing unit is elevatably supported in the image forming device in the vertical direction thereof and the connection between the toner hopper and the developing unit can be cancelled by lifting up the toner hopper when drawing out the developing unit so that the structure of the connection portion therebetween can be simplified and the sliding portion can be eliminated to thereby eliminate wearing at the connection therebetween. Furthermore, an apparatus for automatically raising and lowering the toner hopper and an apparatus for maintaining the horizontality of the toner hopper when being elevated and lowered is provided.

9 Claims, 10 Drawing Sheets

DEVELOPER UNIT AND A TONER HOPPER FOR AN IMAGE FORMING DEVICE

BACKGROUND OF THE INVENTION

1. Field of the Invention

The present invention relates to an image forming device and especially relates to such a structure thereof as the junction between a developing unit and a toner hopper can be rationally accomplished.

2. Description of the Prior Art

FIG. 12 is a perspective view showing a separated condition of a developing unit 1 and a toner hopper 2, which are to be used in a conventional image forming device in the background of the present invention. Toner which is supplied through a toner supplying port 3 of the toner hopper 2, which is arranged upwards of the developing unit 1, is conveyed to this side in FIG. 12 by means of a spiral toner conveyor roller (not illustrated) which is installed downwards of the toner hopper 2, and toner is subsequently supplied from an opening 6 of a toner discharge shutter 5 to a toner replenishing port 7 of the developing unit.

And the toner is evenly supplied to a developing roller by means of a conveyor roller or an agitating roller (both of which are not illustrated) which are provided in the developing unit 1.

Such an image forming device is so composed that the developing unit 1 can be drawn out from the image forming device proper by pulling out the developing unit 1 in the axial direction of the developing roller (i.e., the direction of an arrow "A") when carrying out maintenance and inspection work, for instance, for treatment of a jammed paper. However, at this time, as the toner hopper 2 remains installed in the image forming device, such a structure that the toner replenishing port 7 of the developing unit 1 and the toner discharge shutter 5 of the toner hopper 2 can slide relative to each other has been employed.

Therefore, it is necessary to secure a high positioning accuracy at this sliding portion. In the case that the positioning accuracy is not good and there must be a clearance between the toner replenishing port 7 and the toner discharge shutter 5, there are such problems as toner may leak or on the contrary, the toner replenishing port 7 and the toner discharge shutter 5 may be damaged by sliding thereof unless there is a prompt allowance therebetween.

As it is necessary to secure a high positioning accuracy at the sliding portion as shown in the above, it is much desired that the area of the sliding portion be made as small as possible, and the junction portion (the sliding portion) which is a supplying channel through which toner is supplied from the toner hopper 2 to the developing unit 1 is also required to be made small. For this purpose, after the toner is supplied to the toner replenishing port 7 of the developing unit 1 once the toner in the toner hopper 2 is conveyed to the side of the toner discharge shutter 5 at one side of the toner hopper 2, the toner which is supplied to.. the toner replenishing port 7 must be conveyed through out the range of the developing unit 1. Therefore, the toner supplying process may become very complicated, thereby causing such a structure as shown in the above to result in an increased cost of production.

INVENTION

Therefore, it is a primary object of the present invention to provide an image forming device in which the developing unit 1 and the toner hopper 2 do not have any sliding portion when drawing out the developing unit from the image forming device proper.

In order to accomplish the object, the first inventive point according to the present invention is that an image forming device proper in which a developing unit and a toner hopper arranged upwards of the developing unit are included and the developing unit can be drawn out from and mounted in the image forming device by sliding the developing unit in the axial direction of the developing roller thereof comprises vertical supporting means by which the toner hopper can be freely elevated and lowered in the vertical direction for the developing unit.

According to the invention, in the case of drawing out the developing unit from the image forming device proper, the toner hopper can be elevated upwards of the developing unit, thereby causing the junction therebetween to be separated. Therefore, it is possible to draw out the developing unit without forming any sliding portion with the toner hopper.

In the case that as shown in the above the toner hopper is freely elevated and lowered, it is necessary to prevent the toner hopper from being inclined.

It is therefore a secondary object of the invention to provide means for preventing the toner hopper from being inclined while being elevated and lowered.

In order to accomplish the object, the second inventive point according to the invention is that an image forming device proper in which a developing unit and a toner hopper which is arranged upwards of the developing unit are included and the toner hopper can be elevated and lowered in the vertical direction for the developing unit when the developing unit is drawn out from and mounted in the image forming device by sliding the developing unit in the axial direction of the developing roller thereof, comprises means for horizontally maintaining the toner hopper when elevating and lowering the toner hopper in the vertical direction.

Unless the toner replenishing port of the toner hopper is closed when drawing out the developing unit by elevating the toner hopper as shown in the above, the toner may be spilled to cause the surrounding thereof to be contaminated.

For this reason, the inventor so invents that the toner replenishing port can be closed by providing the toner hopper with a shutter. It is desired that the shutter is opened and closed together with the elevation and lowering movements of the toner hopper, thereby causing the shutter to be opened and closed without fail.

In order to accomplish these objects, the third inventive point is that an image forming device proper in which a developing unit and a toner hopper which is arranged upwards of the developing unit are included and the toner hopper can be elevated and lowered in the vertical direction for the developing unit when the developing unit is drawn out from and mounted in the image forming device by sliding the developing unit in the axial direction of the developing roller thereof, comprises a shutter which is installed in the vicinity of the toner replenishing port of the toner hopper and by which the toner replenishing port can be opened and closed and means for driving the shutter, by which the shutter can be opened and closed in interlocking with the elevation and lowering movements of the toner hopper.

And the fourth inventive point to secure reliable opening and closing of the shutter is that an image forming device proper in which a developing unit and a toner hopper which is arranged upwards of the developing unit are included and the toner hopper can be elevated and lowered in the vertical direction for the developing unit when the developing unit is drawn out from and mounted in the image forming device by sliding the developing unit in the axial direction of the developing roller thereof, comprises a shutter which is installed in the vicinity of the toner replenishing port of the toner hopper and by which the toner replenishing port can be opened and closed, an operating member which can elevate and lower the toner hopper, and means for linking the shutter with the operating member so that the shutter can be closed and opened together with the movements of the operating member.

It is much desirable that the elevation and lowering drive of the toner hopper is automated by not depending upon manpower but by using an actuator (elevation and lowering drive means) like a motor, etc. However, in this case, in the case that the actuator can be operated in accompanying with such a preparatory operation for taking out the developing unit as, for instance, opening the front cover or disconnecting the lock cancelling lever of the developing unit, further manpower saving operation can be accomplished.

In order to accomplish these objects, the fifth inventive point is that an image forming device in which a developing unit and a toner hopper which is arranged upwards of the developing unit are included in the image forming device proper and the toner hopper can be elevated and lowered in the vertical direction for the developing unit when the developing unit is drawn out from and mounted in the image forming device by sliding the developing unit in the axial direction of the developing roller thereof, comprises the elevation and lowering drive means of the toner hopper and switching means to operate according to the preparatory operation for mounting the developing unit in and drawing out the developing unit from the image forming device, both of which being mounted in the image forming device, and the elevation and lowering drive means of the toner hopper being able to operate according to the switching means.

In any of the above cases, it is much desirable as a matter of course that the installing condition of the toner hopper is stabilized with the toner hopper raised and with the toner hopper placed in the developing unit.

The sixth inventive point disclosed at this standpoint is that an image forming device which is provided with a developing unit, the toner hopper placed upwards of the developing unit, a hopper shaft fixed at the toner hopper, a cam member engaged with the hopper shaft and a lever shaft which is integrally combined with the cam member in a body and is so arranged as to be rotatable in the image forming device and in which the toner hopper can be elevated and lowered in the vertical direction for the developing unit by rotating the lever shaft when drawing out the developing unit from and mounting it in the image forming device by sliding the developing unit in the axial direction of the developing roller comprises an engaging groove which can be engaged with the hopper shaft of the toner hopper when the toner hopper is elevated for the developing unit and the connection therewith is cancelled and an engaging protrusion for pushing the toner hopper engaged with the hopper shaft of the toner hopper toward the side of the developing unit when the toner hopper is lowered for the developing unit and the connection therewith is effected, both the engaging groove and protrusion being mounted on the cam member.

It is necessary for the toner hopper to be elevated when drawing out the developing unit. And on the contrary the toner hopper must be lowered after the developing unit is mounted in a position.

Therefore, manpower saving can be much more accomplished in the case that elevation and lowering of the toner hopper are interlocked with draw-out and mounting of the developing unit.

For this reason, the seventh inventive point of the present invention is that an image forming device proper in which a developing unit and a toner hopper which is arranged upwards of the developing unit are included and the toner hopper can be elevated and lowered in the vertical direction for the developing unit when the developing unit is drawn out from and mounted in the image forming device by sliding the developing unit in the axial direction of the developing roller thereof, comprises interlocking means by which the toner hopper can be elevated and lowered in the vertical direction for the developing unit together with the drawing-out and mounting movements of the developing unit.

Also in the seventh inventive point of the present invention, it is important for the toner hopper to be maintained on the horizontal condition thereof while being in elevating and lowering operation. At such a standpoint as shown in the above, the image forming device according to the seventh inventive point comprises horizontally supporting means as well as in the second inventive point.

This specification of the present invention specifically points out the subject thereof and is complete with the claims clearly claimed. The above, and other objects, features and advantages of the present invention, will become apparent from the following description taken in conjunction with the accompanying drawings.

DETAILED DESCRIPTION OF THE PREFERRED EMBODIMENTS

Figure 1:
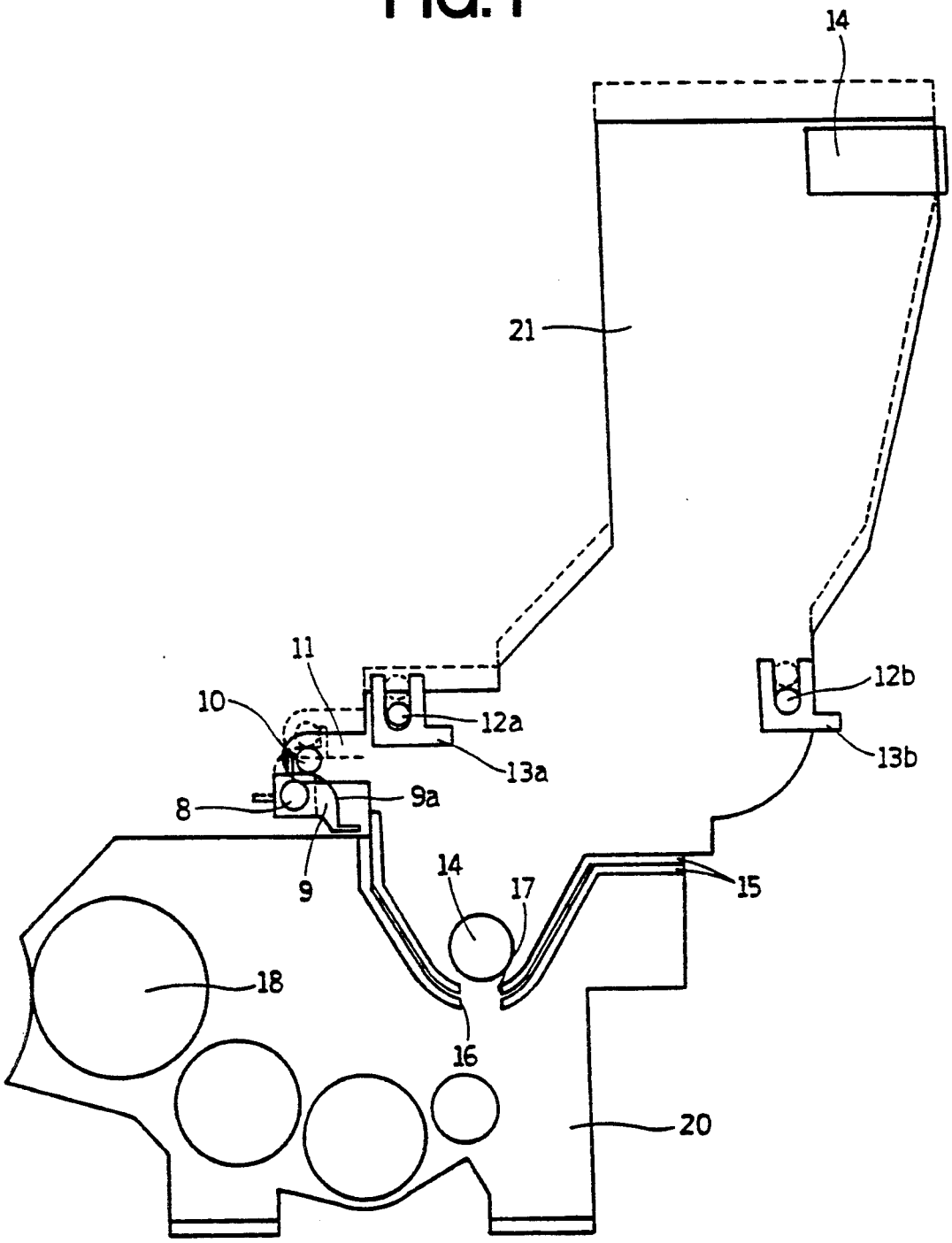
FIG. 1 is a structural view showing the outline of a developing unit and a toner hopper of the image forming device according to the first embodiment of the invention.
Figure 12:
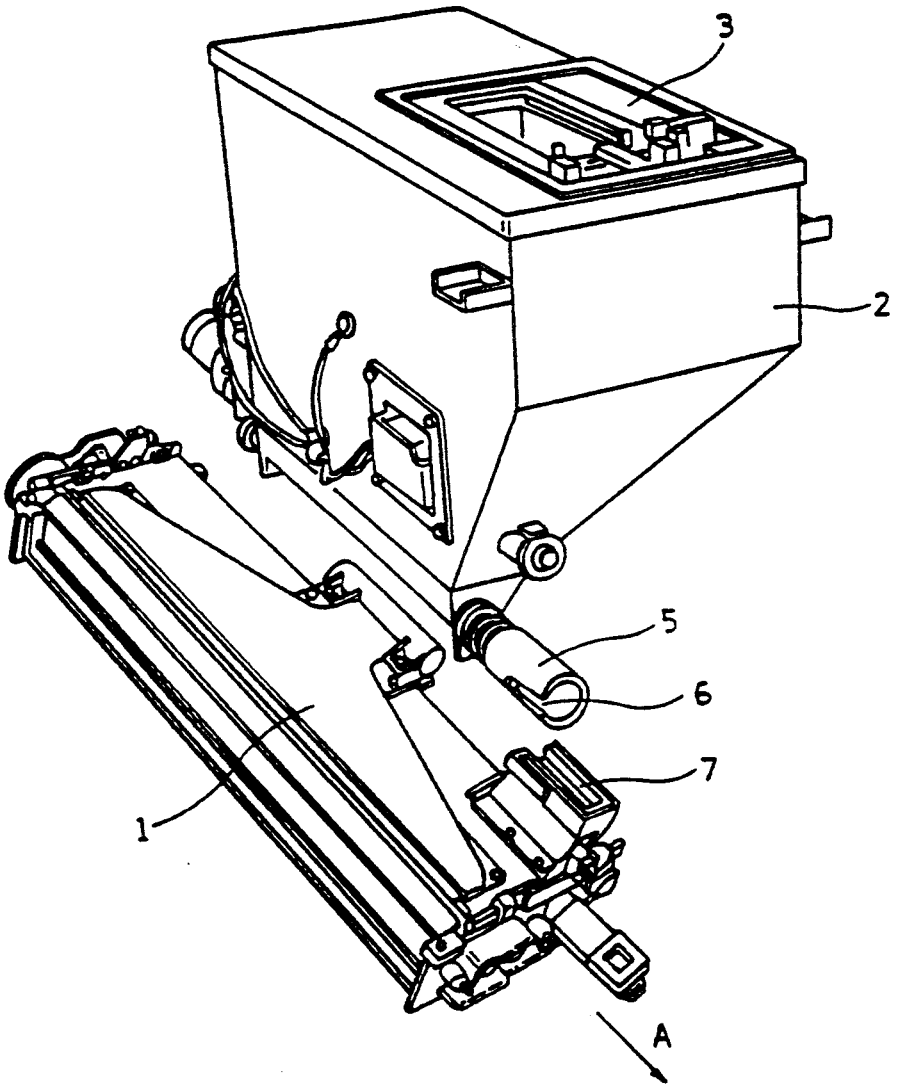
FIG. 12 PRIOR ART
FIG. 12 is a perspective view showing the developing unit and the toner hopper of a conventional image forming device.

In the first embodiment shown in FIG. 1, the point which is different from the conventional developing unit 1 and toner hopper 2 shown in FIG. 12 is that when drawing out the developing unit 20 from the image forming device the toner hopper 21 is so composed that it can be elevated upwards in FIG. 1. On the contrary, as a matter of course, the toner hopper can be lowered to the position as it was, when placing or mounting the developing unit 20 in the image forming device 21.

Namely, when removing the developing unit 20, firstly in the case of turning on a switch (not illustrated), the axis 8 which rotates by drive of a motor, etc., rotates counterclockwise in FIG. 1. As the axis 8 rotates, the cam 9 which is integrally fixed at the end thereof rotates counterclockwise, and the elevation pin 10 engageable with the sliding surface 9*a* of the cam 9 is lifted upwards in FIG. 1.

As the elevation pin 10 is fixed at the toner hopper by way of the bracket 11, the toner hopper 21 is elevated upwards in FIG. 1 in accompanying with the rotation of the cam 9 (the dashed lines). In this embodiment, as shown in FIG. 1, two elevation guide pins 12*a* and 12*b* are arranged at both the sides of the toner hopper 21, respectively (four guide pins in all), and roughly F-shaped elevation guide members 13*a* and 13*b* for guiding these elevation guide pins 12*a* and 12*b* are fixed at the body side of the image forming device, thereby causing the elevation of the toner hopper 21 to be guided. In the case that the elevation and lowering of the toner hopper 21 are guided only by means of the elevation guide members 13*a* and 13*b*, smooth elevation of the toner hopper 21 may not be expected because the toner hopper 21 may rotate clockwise with the elevation guide pin 12*b* at the side of the elevation guide member 13*b* likely to be operated as fulcrum. Hereupon, the direction of the elevation and lowering movements of the toner hopper by the cam 9 is controlled by arranging an elevation guide plate 14, which is slidably brought into contact with the upper end wall portion of the toner hopper 21, at the body side of the image forming device, which is upward of the toner hopper 21.

Contrarily, in the case that the switch not illustrated is turned off after the developing unit 20 is mounted in the image forming device, the toner hopper 21 returns to the position as it was, by reverse rotation of the motor, etc.

In such an embodiment as shown in the above, as any sliding portion is not constituted together with the toner hopper 21 when removing the developing unit 20 from the image forming device proper, it is possible to secure adhesivity of the junction between the developing unit 20 and the toner hopper 21 by arranging sealing members 15 and 15 made of urethane foam, etc. at the junction therebetween.

By so composing as shown in the above, it is possible to form a large toner supplying port 16 at the side of the developing unit 20 and a large toner discharge portion 17 at the side of the toner hopper 21 in the axial direction of the developing roller 18, respectively. A toner conveyor roller like a screw feeder, etc. for conveying toner into the toner hopper 21 or into the developing unit 20 can be eliminated.

According to this embodiment, as the junction portion of the developing unit 20 with the toner hopper 21 is separated when removing the developing unit and it is not necessary to slide the junction portion, high positioning accuracy of the junction portion is not needed. In accompanying therewith, the toner supplying channel from the toner hopper 21 to the developing unit 20, which is obliged to be made small before, can be made large in the axial direction of the developing roller, thereby causing the toner supplying process to be simplified and the cost of production thereof to be much decreased.

In the case of the developing unit shown in FIG. 1, there was a problem that toner which is left over in the vicinity of the toner discharge portion 17 of the toner hopper 21 may be splashed over due to vibrations, etc. on elevating the toner hopper and may contaminate the surroundings.

Figure 2:
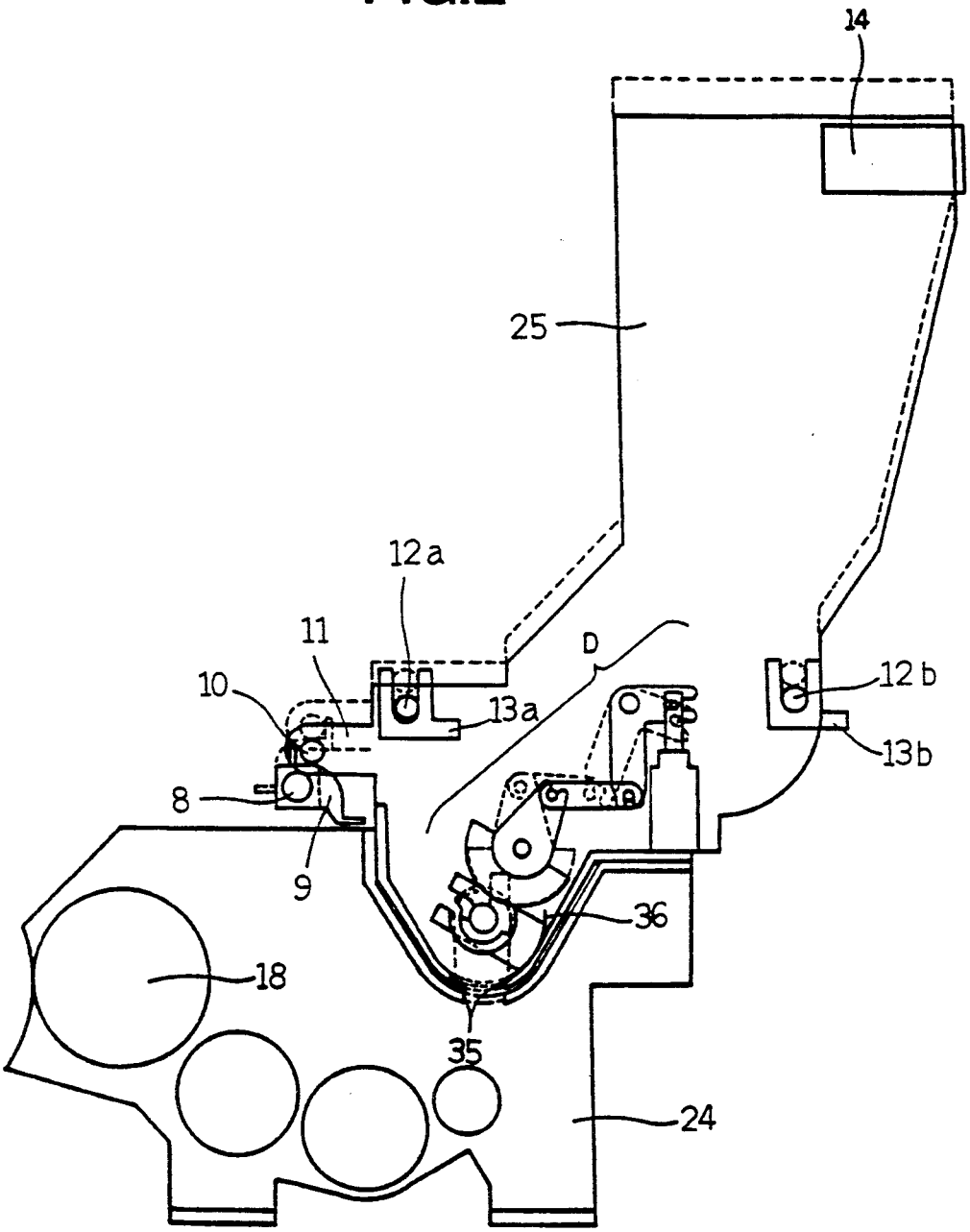
FIG. 2 is a structural view showing the outline of a developing unit and a toner hopper of the image forming device according to the second embodiment of the invention.
Figure 3:
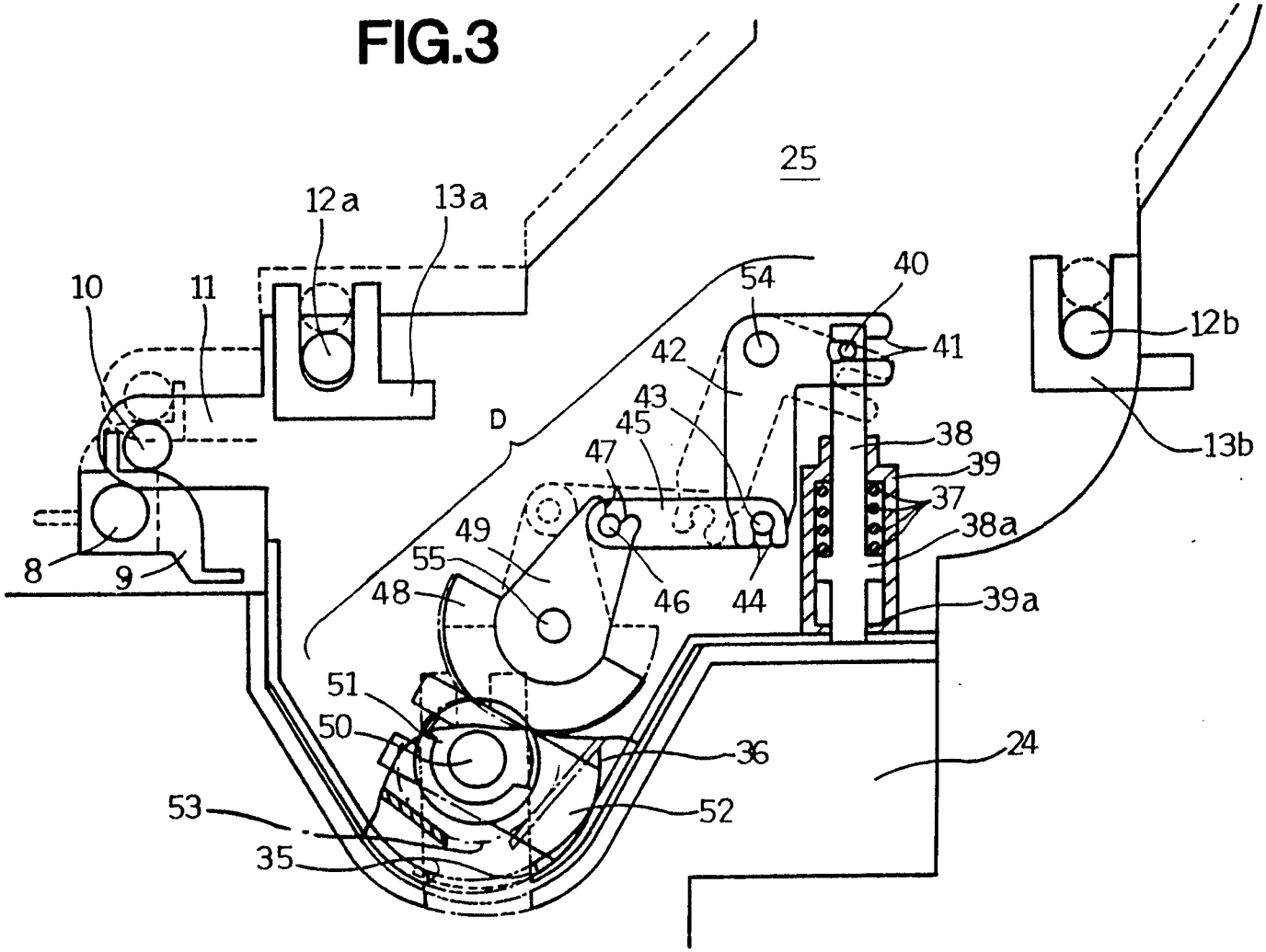
FIG. 3 is an enlarged structural view showing the main portions of the image forming device shown in FIG. 2.

Such problems are solved and improved in the second embodiment shown in FIGS. 2 and 3.

The main elements in FIGS. 2 and 3 which are common to those in FIG. 1 are given the same reference numbers. In this embodiment, the point which is different from the image forming device shown in FIG. 1 is, as shown in FIG. 2, that a link mechanism "D" is arranged at the outside of the toner hopper 25 and a shutter 36 is provided in order to open and close the toner replenishing port 35 by the link mechanism "D".

As shown in FIG. 3, the link mechanism "D" comprises a cylinder 39 which gives energy to push a flange portion 38*a* of a piston rod 38 downwards in FIG. 3 by means of an internal compression coil spring 37, a roughly L-shaped lever 42 which is provided at one end thereof with a fork portion 41 engageable with a pin 40 which is fixed at the tip end of the piston rod 38, a link 45 which is provided at one end thereof with a fork portion 44 engageable with another pin 43 which is fixed at the other end of the lever 42, and a lever 49 having a fork portion 47 engageable with still another pin 46 fixed at the other end of the link 45 at one end thereof and having a fan-like gear 48 at the other end thereof.

On the other hand, the shutter 36 is integrally combined in a body with a pinion 51 by way of a bracket 52. The pinion 51 is coaxially arranged on an axis 50 of a toner replenishing roller 53 (shown in FIG. 3) arranged in the vicinity of the toner replenishing port 35 of the toner hopper 25, and the pinion 51 is rotatable, centering around the axis 50 and is engaged with the fan-like gear 48.

Therefore, in the case that the axis 8 (lever axis) rotates and the toner hopper 25 is elevated when drawing out the developing unit 24 from the image forming device proper, the piston rod 38 whose downstroke in FIG. 3 is stopped by being brought into contact with the developing unit 24 can go downwards for the toner hopper 25 as being pushed by the compression coil spring 37. By the downstroke of the piston rod 38, the roughly L-shaped lever 42 sways clockwise by way of the pin 40, centering around a fulcrum 54. As the roughly L-shaped lever 42 sways, the link 45 moves leftwards by way of the pin 43. As the link 45 moves, the lever 49 rotates counterclockwise by way of a pin 46, centering around another fulcrum 55. As the lever 49 rotates, the shutter 36 closes the opening of the toner replenishing port 35 by way of the fan-like gear 48, the pinion 51, and the bracket 52 (the opening moves to the position shown by a dashed line). And the piston rod 38 comes to a stop when the flange portion 38 thereof is brought into contact with the bottom 39*a* of the cylinder 39, and the developing unit 24 can be drawn out from the image forming device proper without the lower end of the piston rod 38 being brought into contact with the developing unit 24.

On the contrary, in the case of mounting the developing unit 24 in the image forming device proper, as the toner hopper 25 goes downwards and the lower part of the piston rod 38 is brought into contact with the developing unit 24, the piston rod 38 goes upwards up to the position shown with the original solid lines in relation to the toner hopper 25 to the contrary. And the elevation movement of the piston rod 38 is transmitted to the shutter 36 by way of the roughly L-shaped lever 42, the link 45, the lever 49, the fan-like gear 48, the pinion 51, and the bracket 52, thereby causing the toner replenishing port 35 to be opened.

According to this embodiment, it can be well prevented that toner is splashed over from the toner replenishing port 35 when the developing unit 24 is drawn out from and mounted in the image forming device proper, and the developing unit 24 can be drawn out from and mounted in the image forming device proper without contaminating the surroundings.

According to the image forming device shown in FIGS. 2 and 3, there are a few cases that the underside of the toner hopper 25 is not completely brought into contact with the upper side of the developing unit 24, for instance, owing to some play, regardless of that the axis 8 (lever axis) has been rotated up to the appointed position where the toner hopper 25 and the developing unit 24 are connected with each other on the downstroke of the toner hopper. As a result, there are a few cases that the the opening and closing mechanism of the shutter 36 can not normally operate to cause the toner replenishing port 35 to be kept on being closed by the shutter 36, thereby causing toner not to be supplied from the toner hopper 25 to the developing unit 24.

Figure 4:
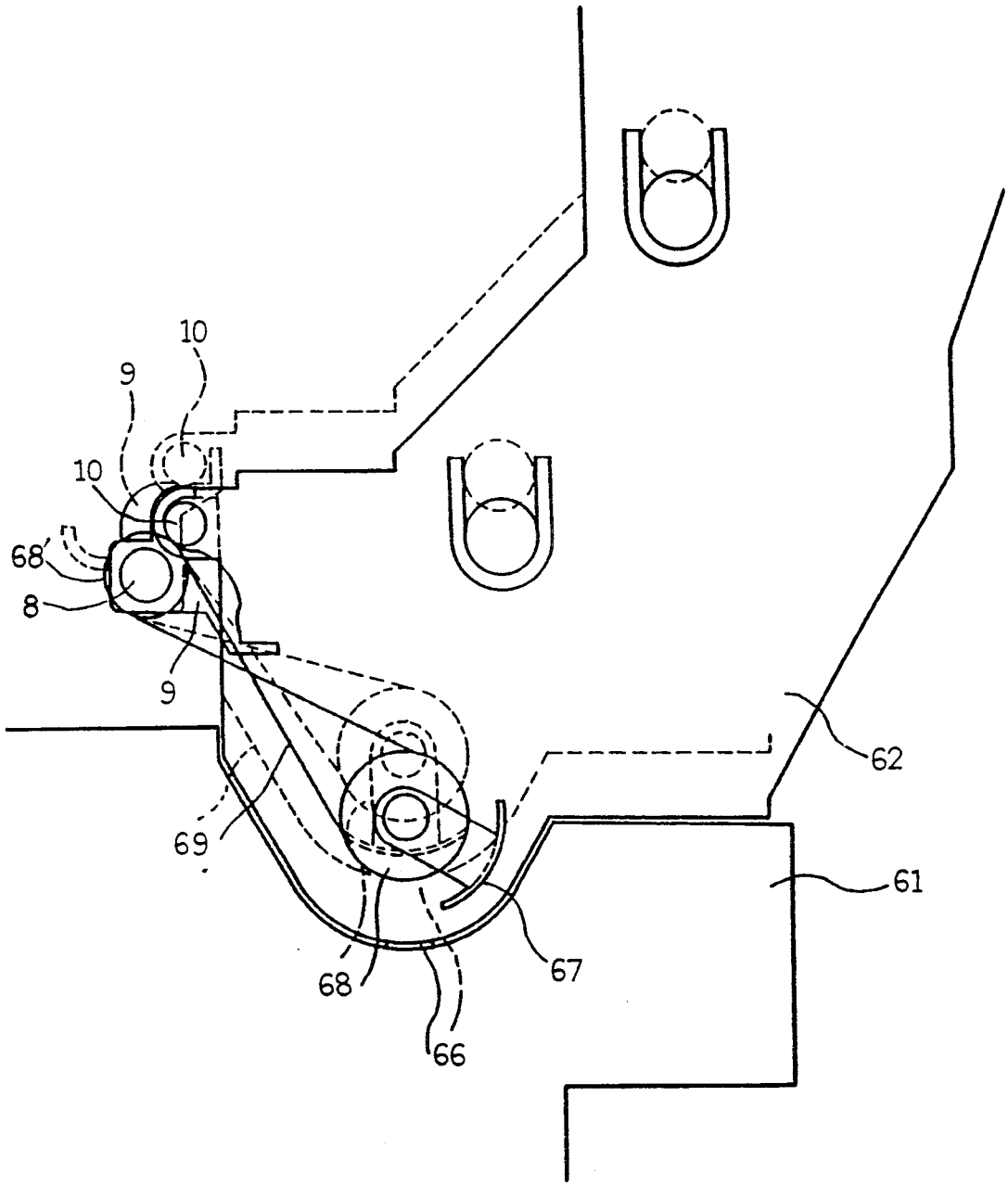
FIG. 4 is a sectional view showing the third embodiment of the invention.

The third embodiment shown in FIG. 4 has solved such a problem as shown in the above. The elements which are common to those shown in FIGS. 2 and 3 are given the same reference numbers.

Further in details, at the lower part of the toner hopper 62 is provided a toner replenishing port 66 by which toner in the toner hoper 62 is replenished to the developing unit 61 by means of a toner replenishing roller, etc. not illustrated. A pulley 68 at which the shutter 67 is mounted for opening and closing the toner replenishing port 66 is rotatably arranged at the side wall face of the toner hopper 62, and another pulley 68′ is also mounted at one end of the axis 8 (the lever axis). A transmission belt 69 is provided between both the pulleys 68 and 68′. At this time, the drive transmission belt 69 is so provided between both the pulleys 68 and 68′ that the shutter 67 can close the toner replenishing port 66 when the axis 8 rotates in such a direction that the toner hopper is elevated, and that the shutter 67 can open the toner replenishing port 66 when the axis 8 rotates in such a direction that the toner hopper 62 is lowered.

Subsequently, the action of this embodiment is explained herebelow. In the case that the axis is rotated counterclockwise when removing the developing unit 61 from the image forming device proper, the pulley 68′ at the side of the axis 8 is driven counterclockwise by the drive transmission belt 69 and the pulley 68 at the side of the shutter 67 is driven and rotated clockwise as shown by the dashed lines in FIG. 4.

Therefore, the toner replenishing port 66 is gradually closed by the shutter 67 as the toner hopper 62 goes upwards for the developing unit 61, and when the axis 8 is rotated up to the appointed position, the toner replenishing port 66 is closed by the shutter 67.

On the other hand, in the case that the axis 8 is rotated clockwise when the developing unit 61 is mounted in the image forming device proper and the toner hopper 62 is connected to the developing unit 61, the pulley 68 at the side of the toner hopper 62 is driven and rotated counterclockwise together with the above movement as shown by the solid lines, thereby causing the toner replenishing port 66 to be opened by the shifting movement of the shutter 67 which has closed the toner replenishing port 66 as the toner hopper 62 is going downwards for the developing unit 61. And when the axis 8 has been rotated up to the appointed position, the toner replenishing port 66 has been completely opened. Under this condition, the toner hopper 62 is connected to the developing unit 61.

In this embodiment, a combination of pulleys 68 and 68′ and the belt 69 has been used as transmission mechanism for transmitting the rotation of the axis 8 to the shutter 67. However, the transmission mechanism thereof is not limited to this case mentioned above. A combination of gears may be used for this purpose.

According to this embodiment, as the opening and closing of the shutter 67 is interlocked with the rotation movement of the axis 8, the shutter 67 can be completely closed or opened.

Figure 5:
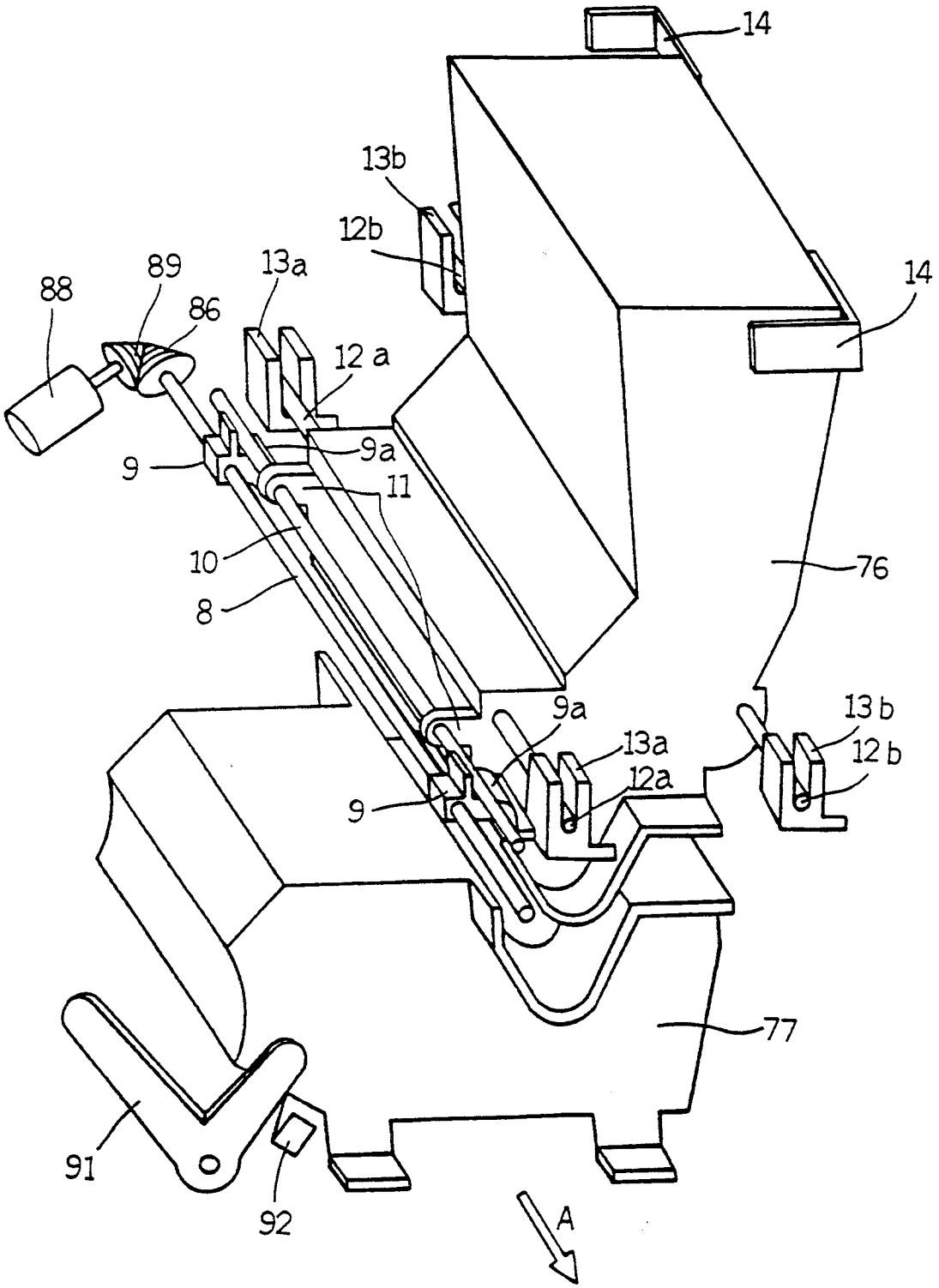
FIG. 5 is an enlarged perspective view showing the main portions of the image forming device according to the fourth embodiment of the invention.

Next, with reference to FIG. 5, the fourth embodiment to automate the elevation and lowering of the toner hopper is explained herebelow. The elements which are common to those shown in FIGS. 1 to 4 are given the same reference number.

An image forming device according to this embodiment is internally provided with a developing unit 77 and a toner hopper 76 which is placed on the developing unit 77, both of which are such as shown in FIG. 5. Two elevation guide pins 12*a* and 12*b* are fixed at both the sides of the toner hopper, respectively. In addition, the elevation guide member 13*a* and 13*b* by which the guide pins 12*a* and 12*b* are guided and a pair of guide plates 14 and 14 by which the upper end wall portion of the toner hopper 76 is guided are provided on the image forming device proper.

An elevation pin 10 is fixed by way of brackets 11 in the toner hopper 76. The elevation pin 10 is supported by means of cams 9 and 9. The cams 9 and 9 are fixed at the axis 8 which is provided with a gear 86 at one end thereof, and the gear 86 is engaged with another gear 89 fixed at the tip end of the motor 88.

The elevation drive means of the toner hopper 76 is so composed as shown in the above.

On the other hand, a switch 92 which is one of the examples of the switching means to actuate the elevation drive means is so arranged that the switch 92 can interlock with such a preparatory operation as operating the lock cancelling lever 91 to cancel the locking of the developing unit for the image forming device proper when opening the front cover of the image forming device or removing the developing unit from or mounting it in the image forming device proper. The shutters 36 and 67 which can open and close the toner replenishing port 16, 35 or 66, and the drive unit thereof are not illustrated.

Therefore, in the case of drawing out the developing unit 77 from the image forming device proper, firstly the lock cancelling lever 91 is rotated counterclockwise in FIG. 5 for a preparatory operation to cancel the lock between the developing unit 77 and the image forming device proper. Then, the switch 92 which is in contact with the lock cancelling lever 91 is separated from each other and the switch 92 is turned on, and the motor 88 rotates the axis 8 counterclockwise in FIG. 5 by way of the gear 89 fixed at the tip end of the motor 88 and another gear 86 engageable with the gear 89. As the axis 8 rotates, the cams 9 and 9 fixed on the axis 8 rotates as well. The elevation pin 10 is lifted up along the sliding faces 9*a* and 9*a*. And the upward movement of this elevation pin 10 is transmitted to the toner hopper 76 by way of the bracket 11, thereby causing the toner hopper 76 to be elevated as the elevation pins 12*a* and 12*b* and the upper section of the toner hopper 76 are being guided by the elevation guide members 13*a* and 13*b* and the elevation guide plate 14. Thus, after the toner hopper 76 is separated from the developing unit 77, the developing unit 77 slides in the axial direction (in the direction of an arrow "A") of the developing roller and is drawn out from the image forming device proper.

In contrast, when mounting the developing unit 77 in the image forming device proper, the developing unit 77 is mounted and the lock cancelling lever 91 is rotated clockwise under such a condition that the toner hopper 76 is separated from the developing unit 77. Then, the switch 92 is operated and the elevation drive means of the toner hopper operates in the reversed direction of the above direction, thereby causing the toner hopper 76 to be lowered to the original position thereof. According to this embodiment, as the toner hopper 76 is elevated and lowered for the developing unit 77 when drawing out the developing unit 77 from and mounting it in the image forming unit proper, any sliding movement does not occur between the toner hopper 76 and the developing unit 77, and as the elevation means of the toner hopper is driven in interlocking with a preparatory operation for drawing out the developing unit 77 from and mounting it in the image forming device proper, the elevation operation of the toner hopper 76 can be automated, and the working efficiency can be further increased.

Hereupon, in either of the above developing units, there have occurred a few cases that the toner hopper 21, 25, 62 or 76 might go down with the elevation pin 10 come off from the cam 9 due to vibration which is produced when removing the developing unit from the image forming device, under such a condition that the toner hopper 21, 25, 62 or 76 is elevated for the developing unit 20, 24, 61 and 77 and the connection thereof with the developing unit 20, 24, 61 or 77 is cancelled. And as either of the toner hopper 21, 25, 62 or 76 is linked with a developing unit 20, 24, 61 or 77 only by the self-weight of the toner hopper 21, 25, 62 or 76 under such a condition that the toner hopper 21, 25, 62 or 76 can be lowered for the developing unit 20, 24, 61, or 77 and can be connected with the developing unit 20, 24, 61, or 77, the adhesivity between the toner hopper 21, 25, 62 or 76 and the developing unit 20, 24, 61, or 77 can be lowered when for instance the toner in the toner hopper 21, 25, 62 or 76 is consumed and all the weight of the toner hopper 21, 25, 62 or 76 become equal to that only the toner hopper, thereby causing the toner in the toner hopper 21, 25, 62 or 76 to be splashed out and to contaminate the inside of the image forming device proper.

Figure 6:
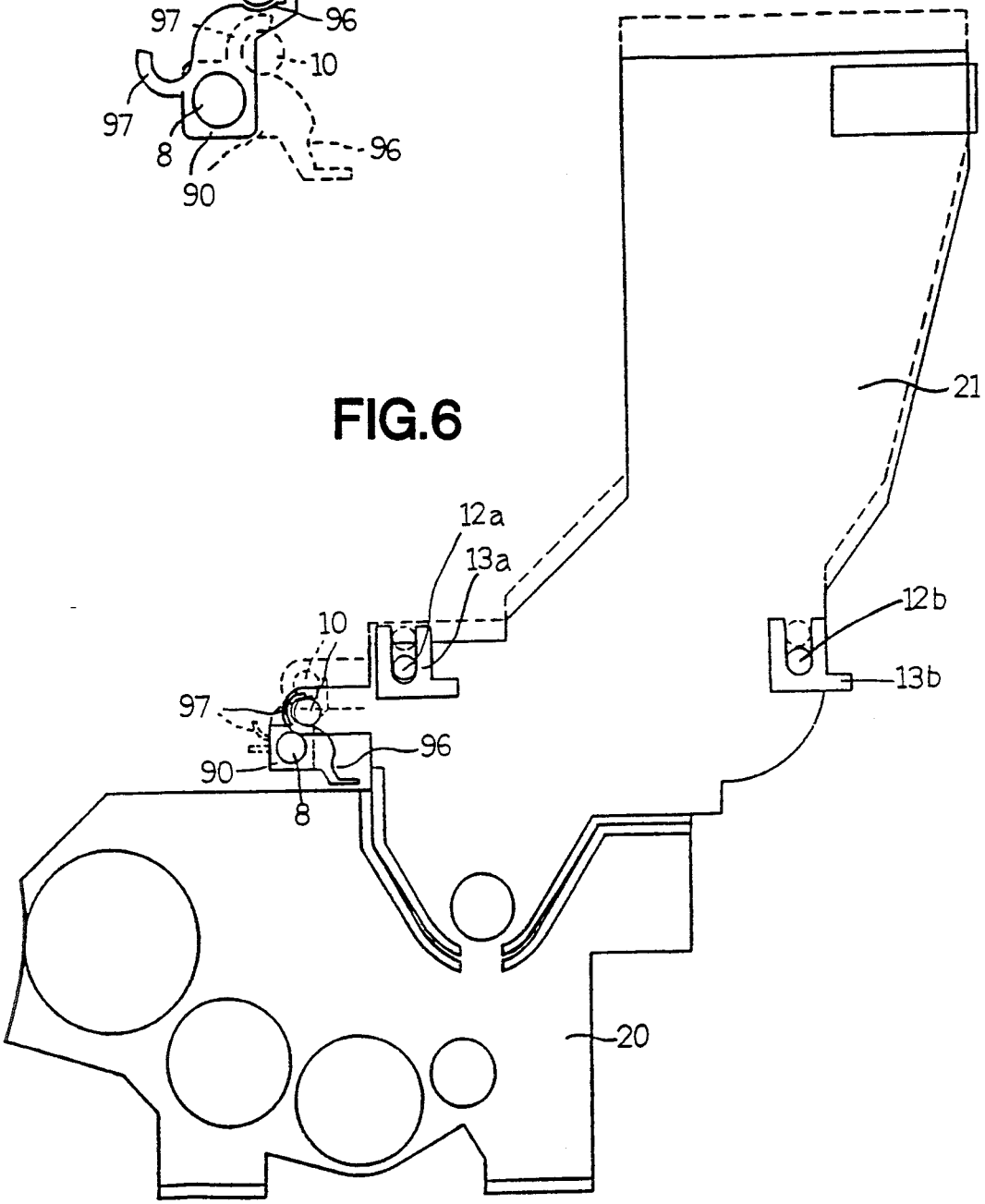
FIG. 6 is a sectional view showing the main portions of the fifth embodiment of the invention.

The fifth embodiment shown in FIG. 6 is to solve such problems as shown in the above. The case that the fifth embodiment applies to the image forming device shown in FIG. 1 will be explained hereunder as one of the representative examples. The main elements which are common to those shown in FIG. 1 are given the same reference numbers.

Figure 7:
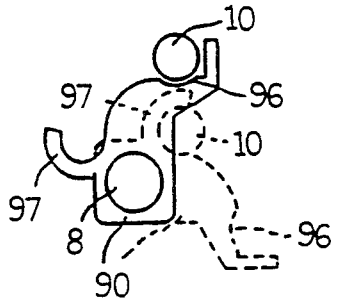
FIG. 7 is an enlarged view showing the main portions of the image forming device shown in FIG. 6.

In this embodiment, the point which is different from the embodiment shown in FIG. 1 is that as shown in FIGS. 6 and 7 an engaging groove 96 which can be engaged with the elevation pin 10 of the toner hopper 21 when the toner hopper 21 is elevated for the developing unit 20 and the connection thereof with the developing unit 20 is cancelled, and an engaging protrusion 97 which engages with the elevation pin which pushes the toner hopper 21 to the developing unit 20 when the toner hopper 21 is lowered for the developing unit 20 and the connection thereof with the developing unit is effected are provided.

Here, the engaging groove 96 is so formed that the section thereof may become roughly equal to the section in the outer periphery in the vicinity of the elevation pin 10 so as for the engaging groove 96 to maintain the toner hopper 21 without fail by being engaged with the elevation pin 10. On the other hand, the engaging protrusion 97 is to be just like a circular arc and is so formed that the semi circle formed between the inner surface of the engaging protrusion 97 and the surface of the cam 90 confronting thereto can become roughly equal to the semi circle at the section of the elevation pin 10, thereby causing the toner hopper 21 to be pushed toward the developing unit 20 with the elevation pin 10 engaged.

The action of the embodiment so composed as shown in the above will be described hereunder.

In the case that the developing unit 20 is drawn out from the image forming device proper, if the axis 8 is rotated counterclockwise in FIG. 6, the toner hopper 21 does not come off from the cam 90 due to vibrations, etc. by engagement of the elevation pin 10 of the toner hopper 21 with the engaging groove 96 of the cam 90 when the elevation pin 10 slides and moves on the surface of the cam 90 as shown with the solid lines in FIG. 6 and FIG. 7 and arrives at the appointed position. And in the case that the developing unit 20 is mounted in the image forming device proper, when as shown with the dashed lines in FIG. 6 and FIG. 7 the developing unit 20 arrives at the appointed position as the axis 8 is rotated clockwise in FIG. 6, the elevation pin 10 of the toner hopper 21 is pushed toward the side of the developing unit 20 with the elevation pin 10 securely engaged with the engaging protrusion 97 of the cam 90, thereby causing the connection between the toner hopper 21 and the developing unit 20 to become much better.

According to the image forming device equipped with such a toner hopper elevating and lowering mechanism as shown in FIG. 6 and FIG. 7, the toner hopper 21 can be securely fixed even with the connection thereof with the developing unit 20 cancelled, and the toner hopper 21 can be securely brought into contact with the developing unit 20 with the toner hopper 21 connected with the developing unit 20.

Though the embodiment described in the above is excellent indeed at such a standpoint that the toner hopper can be elevated and lowered for the developing unit, it is necessary to rotate the axis 8 when removing the developing unit 20, 24, 61 or 77 from the image forming device proper and when mounting the developing unit 20, 24, 61 or 77 in the image forming device proper. Therefore, the embodiment is not necessarily satisfactory in the operation efficiency thereof.

The seventh embodiment shown from FIG. 8 through FIG. 11 is to solve the above problems.

Figure 8:
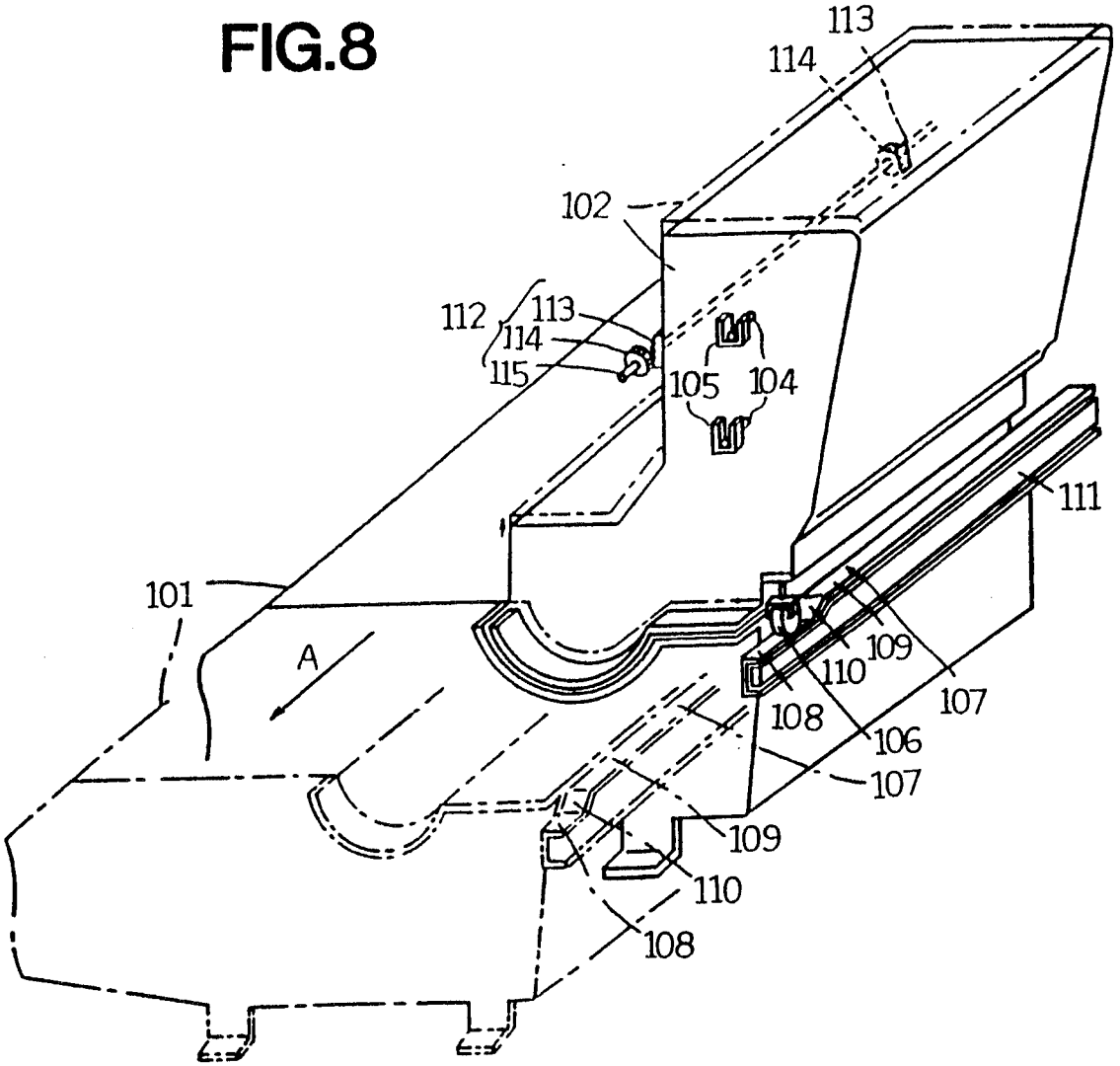
FIG. 8 is a perspective view showing the main portions of the sixth embodiment of the invention.
Figure 9:
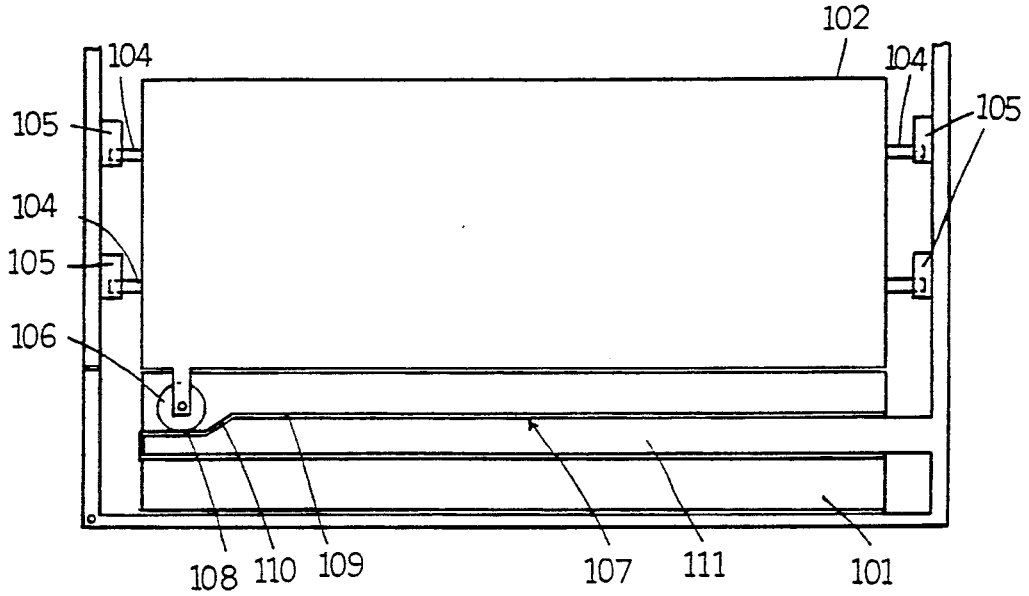
FIGS. 9 and 10 are a sectional view for explaining the operations of the embodiment shown in FIG. 8.
Figure 10:
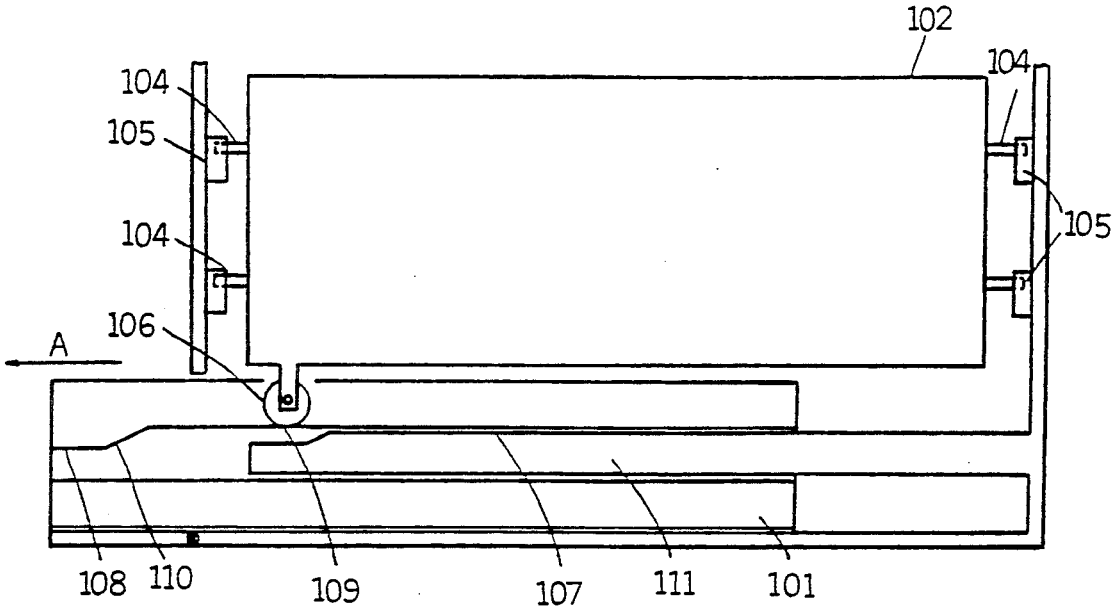

In this embodiment, the point which is different from the embodiments shown from FIG. 1 through FIG. 7 is that as shown from FIG. 8 through FIG. 10 the axis 8 is omitted, a roller 106 is rotatably mounted at one lower part of the toner hopper 102 as rotary member and at the same time an elevation guide member 107 which is in contact with the roller 106 is so provided in the image forming device proper that it can move in the removing and mounting directions in interlocking with the removing and mounting operation of the developing unit 101. Furthermore, the second point which is different from the conventional embodiments is that the toner hopper 102 is provided with a height adjusting mechanism 112 by which the height of the toner hopper can be kept on the same level in the horizontal direction when the toner hopper 102 is elevated and lowered by means of the above elevation guide member 107.

Here, the first different point will be described in details. The elevation guide member 107 is so composed as to comprise an upper stage face 109 on which the roller 106 forming a part of the toner hopper 102 is placed when the developing unit 101 which is removed and mounted in the axial direction (the direction of an arrow "A") of the developing roller (not illustrated) is drawn out in the direction of an arrow "A", an inclined face 110 for connecting the upper stage face 109 to a lower stage face 108 which is formed to be lower than the upper stage face 109, and the lower stage face 108. In addition, the lower stage face 108 and the inclined face 110 are arranged only at a slight area at the end portion at this side of the elevation guide member 107. The remaining area is composed as the upper stage face 109. Furthermore, the developing unit 101 is engaged therewith by means which has been already known to the public and the developing unit 101 is so arranged that it can move in the removing and mounting direction "A" in interlocking with the vertical movements of the toner hopper by sliding on the sliding member 111 fixed in the image forming device proper.

And the second different point will be described in details. The height adjusting mechanism 112 comprises a pair of racks 113 placed at the side of the toner hopper 102 and an adjusting axis 115 to which a pair of pinions 114 are fixed so as to be engageable with the racks 113 and which is rotatably provided in the image forming device.

Subsequently, the action of the image forming device of the embodiment according to the above construction will be explained.

Firstly, as shown with the solid lines of FIG. 8 and in FIG. 9, the roller 106 is in contact with the lower stage face 108 of the elevation guide member 107 by the self weight of the toner hopper 102 with the developing unit 101 connected to the toner hopper 102, thereby causing the developing action to be carried out.

Next, in the case of removing the developing unit 101 from the image forming device proper, the elevation guide member 107 moves in interlocking with the developing unit 101 if the developing unit 101 is slightly pulled in the removing and mounting direction "A" as shown with one-dotted chain lines of FIG. 8 and in FIG. 10, and the face which is in contact with the roller 106 is changed over to the upper stage face 109 by way of the inclined face 110. As a result, the toner hopper 102 is guided and elevated by a combination of the guide 105 and the pin 104 in the image forming device proper, thereby causing the connection with the developing unit 101 to be cancelled. Under this condition, it is possible for the developing unit to be removed.

On the other hand, in the case of mounting the developing 101 in the image forming device proper, the elevation guide member 107 moves in the image forming device proper in interlocking with the developing unit 101 as the developing unit 101 is inserted. And the face with which the roller 106 of the toner hopper 102 is in contact is changed over to the lower stage face 108 from the upper stage face 109 by way of the inclined face 110 just before the developing unit 101 is completely mounted in the image forming device proper. As a result, the toner hopper 102 is lowered just before the developing unit 101 is mounted in the image forming device proper and the toner hopper 102 is connected to the developing unit 101.

Also when the face with the roller 106 is in contact is changed over, the end portion (the deep side in the illustration) at the side where the roller 106 of the toner hopper 102 is not provided is likely to be brought down in the horizontal direction. However, the height adjusting mechanism 112 is provided in this embodiment. Therefore, when the roller is changed over from the lower stage face 108 to the upper stage face 109 (or the upper stage face 109 to the lower stage face 108), the rack 113 at this side (or the opposite side) for the pinion 114 of the adjusting axis 115 arranged in the image forming device proper is elevated together with the toner hopper 102, thereby causing the pinion 114 to be rotated and causing another pinion 114 at the opposite side (the deep side in the illustration) to be rotated by way of the adjusting axis 115 as well.

As a result, as the height at this side and that at the opposite side can be kept nearly at the same level, the toner distribution in the toner hopper 102 can be prevented from being biased in advance and it can become possible for the toner hopper to be smoothly elevated and lowered.

In the above embodiment, the lower stage face 108, the inclined face 110 and the upper stage face 109 of the elevation guide member 107 and the roller 106 of the toner hopper 102 are so arranged that the toner hopper 102 can be elevated, cancelling the connection with the developing unit 101, only by slightly drawing out the developing unit 101 when removing the developing unit 101 and that the toner hopper 102 can be lowered and connected with the developing 101 just before the developing unit 101 is completely mounted in the image forming device proper. Therefore, the work efficiency can be more increased.

Also, in the above embodiment, an image forming device in which one elevation guide member 107 is slidably mounted on a sliding member 111 has been explained as an example. However, the embodiment is not limited to this case. This embodiment can apply to an image forming device in which a supporting member by which for instance, such a developing unit or an image forming unit including the developing unit as disclosed by the Japanese Laid-Open Pat. No. Sho-61-58035 is removably mounted is slidably composed by a pair of sliders between the operating position (the image forming position) of the image forming device and the non-operating position (the take-out position) outside thereof. In this ease, the above elevation guide member 107 is attached to the above supporting member.

Figure 11:
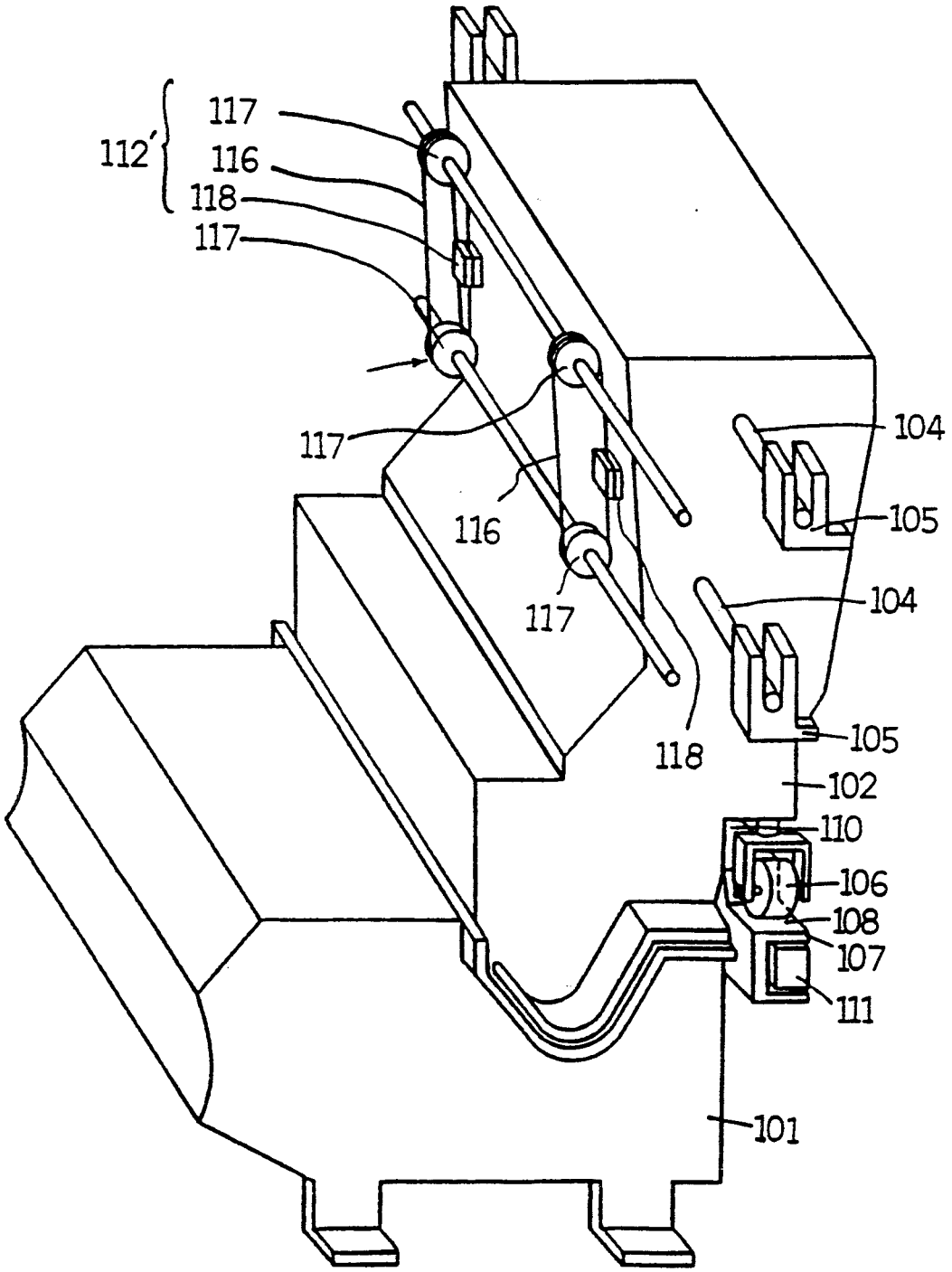
FIG. 11 is a perspective view showing a modification example of the embodiment shown in FIG. 8.

Furthermore, in the above embodiment, the racks 113 and the pinions 114 are utilized as the height adjusting mechanism. The height adjusting mechanism is not also limited to the above case. For instance, as shown in FIG. 11, a height adjusting mechanism 112' in which a belt 116 and a pulley 117, furnished with the belt 116, which can rotate at the same speed in the same direction as those of the belt are mounted, and so composed that the belt 116 can be fixed to the toner hopper 102 by means of a clamper 118 may be used so that the toner hopper 102 can be elevated and lowered without inclination.

Furthermore, the height adjusting mechanisms 112 and 112' are not limited to only the embodiment shown in FIG. 7 but as a matter of course, it can apply to any of the first to the sixth embodiments shown in FIG. 1 through FIG. 7.

According to the seventh embodiment described in the above, the toner hopper 102 can be elevated in interlocking with the removing movement of the developing unit 101 with the toner hopper 102 kept on the horizontal condition in the case of removing the developing unit 101 from the image forming device proper, and can be lowered in interlocking with the mounting movement of the developing unit 101 with the toner hopper 102 kept on the horizontal condition in the case of mounting the developing unit 101 in the image forming device proper Therefore, the toner hopper 102 can be elevated and lowered, with the horizontal condition thereof secured, only by the removing and mounting movements of the developing unit 101.

Thus, the work efficiency can be more increased, and smooth elevation and lowering of the toner hopper in the vertical direction will be accomplished by preventing the toner distribution in the toner hopper 102 from being biased in advance.

The invention can be effected and/or carried out in other embodiments without departing from the spirits and substantial features thereof.

Therefore, though either of the above embodiments is one of the preferred embodiments, the invention is not limited only to the embodiments mentioned in the above.

And it can be easily understood that all the modifications which can be effected in the scope of the claims described hereinafter and the scope meant by the claims are included in the claims hereof.

What is claimed is:

1. An image forming device having a main body including a developing unit and a toner hopper which is arranged upwards of the developing unit and so composed that the developing unit can be removed from and mounted in the image forming device by sliding the developing unit in the axial direction of the developing roller thereof, said image forming device comprising: a vertical supporting means for supporting said toner hopper such that said toner hopper is elevated and lowered relative to said developing unit, the developing unit can be pulled out in said axial direction of the developing roller after the toner hopper is elevated by the vertical supporting means and the toner hopper is separated from the developing unit, leaving the toner hopper in the main body of the image forming device.

2. An image forming device having a main body including a developing unit and a toner hopper which is arranged upwards of the developing unit and so composed that the toner hopper can be elevated and lowered in the vertical direction for the developing unit when the developing unit is drawn out from and mounted in the image forming device proper by sliding the developing unit in the axial direction of the developing roller thereof, said image forming device comprising: a vertical supporting means for supporting said toner hopper such that said toner hopper is elevated and lowered relative to said developing unit, the developing unit can be pulled out in said axial direction of the developing roller after the toner hopper is elevated by the vertical supporting means and the toner hopper is separated from the developing unit, leaving the toner hopper in the main body of the image forming device; and horizontally supporting means to maintain the horizontality of the toner hopper when being elevated and lowered in the vertical direction of the toner hopper.

3. An image forming device having a main body including a developing unit and a toner hopper which is arranged upwards of the developing unit and so composed that the toner hopper can be elevated and lowered in the vertical direction for the developing unit when the developing unit is drawn out from and mounted in the image forming device proper by sliding the developing unit in the axial direction of the developing roller thereof, said image forming device comprising: a vertical supporting means for supporting said toner hopper such that said toner hopper is elevated and lowered relative to said developing unit, the developing unit can be pulled out in the axial direction of the developing roller after the toner hopper is elevated by the vertical supporting means and the toner hopper is separated from the developing unit, leaving the toner hopper in the main body of the image forming device; a shutter installed in the vicinity of a toner replenishing port of the toner hopper for opening and closing the toner replenishing port; and shutter drive means for closing and opening the shutter together with the elevation or the lowering movements of the toner hopper.

4. An image forming device having a developing unit and a toner hopper which is arranged upwards of the developing unit and so composed that the toner hopper can be elevated and lowered in the vertical direction for the developing unit when the developing unit is drawn out from and mounted into the image forming device proper by sliding the developing unit in the axial direction of the developing roller thereof, said image forming device comprising a shutter installed in the vicinity of a toner replenishing port of the toner hopper and for opening and closing the toner replenishing port, an operating member for driving the elevation and the lowering of the toner hopper, and linkage means for linking the shutter with the operating member so that the shutter can be opened and closed together with the operating member.

5. An image forming device having a developing unit and a toner hopper which is arranged upwards of the developing unit and so composed that the toner hopper can be elevated and lowered in the vertical direction for the developing unit when the developing unit is drawn out from and mounted in the image forming device proper by sliding the developing unit in the axial direction of the developing roller thereof, said image forming device comprising driving means for elevating and lowering of the toner hopper and switching means for operating according to a preparatory operation for drawing out the developing unit from and mounting it in the image forming device, said driving means and said switching means being mounted in the image forming device proper, and the driving means for elevating and lowering of the toner hopper being able to operate according to the operation of the switching means.

6. An image forming device having a developing unit, a toner hopper placed upwards of the developing unit, a hopper shaft fixed at the toner hopper, a cam member engaged with the hopper shaft and a lever shaft which is integrally combined with the cam member in a body and is so arranged as to be rotatable in the image forming device, and in which the toner hopper can be elevated and lowered in the vertical direction for the developing unit by actuating the cam member by rotating the lever shaft when drawing out the developing unit from and mounting it in the image forming device by sliding the developing unit in the axial direction of the developing roller, said image forming device further comprising an engaging groove which is engageable with the hopper shaft of the toner hopper when the toner hopper is elevated for the developing unit and the connection therewith is canceled and an engaging protrusion for pushing the toner hopper engaged with the hopper shaft of the toner hopper toward the side of the developing unit when the toner hopper is lowered for the developing unit and the connection therewith is effected, said engaging groove and engaging protrusion being mounted on the cam member.

7. An image forming device having a developing unit and a toner hopper which is arranged upwards of the developing unit and so composed that the toner hopper can be elevated and lowered in the vertical direction for the developing unit when the developing unit is drawn out from and mounted in the image forming device proper by sliding the developing unit in the axial direction of the developing roller thereof, said image forming device further comprising interlocking means for elevating and lowering the toner hopper in the vertical direction for the developing unit together with the removing and mounting of the developing unit, and wherein the interlocking means moves together with the sliding movement of the developing unit, and a toner hopper elevation guide member in which an upper stage face on which the toner hopper is placed when the developing unit is drawn out from the image forming device proper and a lower stage face which is formed to be lower than the upper stage face are consecutively formed is provided.

8. An image forming device claimed in the claim 7, wherein the toner hopper is brought into contact with the upper stage face or the lower stage face by way of a rotating member.

9. An image forming device claimed in the claim 7, wherein horizontally maintaining means is provided in order to secure the horizontally of the toner hopper when being elevated and lowered in the vertical direction of the toner hopper.

* * * * *